US007914076B2

(12) United States Patent
Broering et al.

(10) Patent No.: US 7,914,076 B2
(45) Date of Patent: Mar. 29, 2011

(54) DEVICE WITH A LIMIT SWITCH AND TRUNNION

(75) Inventors: Jacob E. Broering, Yorkshire, OH (US); David C. Edelmann, Sidney, OH (US)

(73) Assignee: Midmark Corporation, Versailles, OH (US)

( * ) Notice: Subject to any disclaimer, the term of this patent is extended or adjusted under 35 U.S.C. 154(b) by 274 days.

(21) Appl. No.: 12/262,995

(22) Filed: Oct. 31, 2008

(65) Prior Publication Data

US 2010/0109407 A1 May 6, 2010

(51) Int. Cl.
*A47C 1/00* (2006.01)

(52) U.S. Cl. ..... 297/330; 297/316; 297/310; 297/353

(58) Field of Classification Search ..... 297/310, 297/330, 316, 353
See application file for complete search history.

(56) References Cited

U.S. PATENT DOCUMENTS

| | | | | | |
|---|---|---|---|---|---|
| 3,578,379 | A | * | 5/1971 | Taylor et al. | 297/71 |
| 3,823,979 | A | * | 7/1974 | Davis, Sr. | 297/330 |
| 3,984,146 | A | | 10/1976 | Krestel et al. | |
| 4,211,451 | A | | 7/1980 | Shephard | |
| 4,304,386 | A | * | 12/1981 | Nagashima et al. | 248/429 |
| 4,407,030 | A | * | 10/1983 | Elliott | 5/616 |
| 4,516,805 | A | * | 5/1985 | Leeper et al. | 297/330 |
| 4,552,403 | A | | 11/1985 | Yindra | |
| 4,650,247 | A | * | 3/1987 | Berg et al. | 297/284.1 |
| 4,761,000 | A | * | 8/1988 | Fisher et al. | 5/608 |
| 4,834,411 | A | * | 5/1989 | Willey et al. | 280/250.1 |
| 4,993,777 | A | * | 2/1991 | LaPointe | 297/325 |
| 5,131,717 | A | | 7/1992 | Kaminiski et al. | |
| 5,190,349 | A | * | 3/1993 | Austin et al. | 297/316 |
| 5,267,778 | A | * | 12/1993 | Krebs et al. | 297/330 |
| 5,467,002 | A | * | 11/1995 | Brooks | 318/553 |
| 5,481,769 | A | * | 1/1996 | Schneider | 5/617 |
| 5,931,532 | A | * | 8/1999 | Kemmerer et al. | 297/330 |
| 6,641,216 | B2 | * | 11/2003 | Rogers et al. | 297/344.2 |
| 6,652,033 | B2 | * | 11/2003 | Satoh | 297/423.3 |
| 7,344,155 | B2 | * | 3/2008 | Mulhern et al. | 280/755 |
| 2002/0148044 | A1 | | 10/2002 | Hayes et al. | |
| 2003/0071503 | A1 | | 4/2003 | Brockway et al. | |
| 2005/0156453 | A1 | | 7/2005 | Lin | |

OTHER PUBLICATIONS

US Patent and Trademark Office; Search Report and Written Opinion in International Patent Application No. PCT/US2009/052104 dated Sep. 15, 2009.

US Patent and Trademark Office; Search Report and Written Opinion in International Patent Application No. PCT/US2009/052096 dated Sep. 15, 2009.

US Patent and Trademark Office; Search Report and Written Opinion in International Patent Application No. PCT/US2009/052066 dated Sep. 3, 2009.

* cited by examiner

*Primary Examiner* — Laurie K Cranmer

(74) *Attorney, Agent, or Firm* — Wood, Herron & Evans, LLP

(57) ABSTRACT

Dental devices with cylinders, trunnions, and limit switches, and a method are provided. The dental devices include a cylinder and a trunnion having a cavity and an outer surface. A portion of the cylinder is slidably mounted within the cavity of the trunnion, and a portion of the cylinder protrudes out of the trunnion. The limit switch is coupled to the outer surface of the trunnion, with the limit switch is operable to contact the cylinder. Separation of the limit switch and the cylinder causes actuation of the limit switch, and the actuation of the limit switch inhibits a downward movement of the device. Alternatively, the limit switch may be coupled to the portion of the cylinder that protrudes out of the trunnion, with the limit switch operable to contact the trunnion. As such, separation of the limit switch and the trunnion causes actuation of the limit switch.

27 Claims, 6 Drawing Sheets

DEVICE WITH A LIMIT SWITCH AND TRUNNION

CROSS-REFERENCE TO RELATED APPLICATIONS

This application is related to the following U.S. patent applications, each assigned to the Assignee of the present application:

U.S. patent application Ser. No. 12/262,887, filed Oct. 31, 2008;

U.S. patent application Serial No. 12/262,966, filed Oct. 31, 2008;

U.S. Design Application Serial No. 29/327,186, filed Oct. 31; 2008; and

U.S. Design Application Serial No. 29/327,189, filed Oct. 31, 2008.

TECHNICAL FIELD

The present invention relates generally to chairs for supporting a patient during examinations and treatments, and more particularly to a chair for use in a dental operatory.

BACKGROUND

Conventional dental operatories generally include an articulating dental chair for supporting a patient in a variety of positions to facilitate the performance of dental procedures and operations. For example, dental chairs are generally adapted to be raised and lowered relative to a floor surface, and to be moved between a first orientation/position where a seatback is upright or inclined relative to a seat base to support the patient in a seated position, and a second orientation/position where the seatback is reclined to support the patient in a generally supine position.

In some dental chairs, the seat cushion is supported by a chair frame and the back cushion is coupled to an upright support that moves relative to the chair frame along a predetermined path or track (i.e., the support does more than merely pivot with respect to the chair frame). This upright support is sometimes referred to as a "carriage." A lower portion of the carriage is typically received between sidewalls of the chair frame. The carriage slides relative to the chair frame between the sidewalls and along the predetermined path to move the dental chair between the first and second orientations mentioned above.

Typically, once the first or second orientation/position is requested by a user, the motions associated with that orientation are performed until completion of the orientation. Often times, however, there may be an obstruction below the seatback that may interfere with the reclining seatback in the second orientation/position. The seatback is typically very heavy as it is meant to support a patient, and may cause pain or discomfort to the obstruction if the obstruction is another person. Despite the obstruction, the seatback typically continues to try to recline, causing additional pain or discomfort.

As an example, a dental hygienist may be sitting with his or her legs below the seatback, get distracted (e.g., assisting the dentist, preparing for the procedures, reviewing the charts, etc.), and not notice that the seatback is reclining until contact with the seatback. Upon contact by the seatback with the hygienist's legs, the seatback typically tries to continue to recline despite the dental hygienist's legs, often causing pain or discomfort. As such, the hygienist may be pinned down by the heavy seatback.

Thus, a need therefore exists in the art for a safer manner of reclining the seatback of the dental chair.

SUMMARY

The invention addresses these and other problems associated with the prior art by providing dental devices with cylinders, trunnions, and limit switches. The dental devices may be dental chairs. When the limit switch of the dental device is actuated, downward movement of the seat back may be stopped, often limiting further pain or discomfort to a user.

In some embodiments, the dental device may comprise a cylinder and a trunnion having a cavity and an outer surface. A portion of the cylinder is slidably mounted within the cavity of the trunnion and a portion of the cylinder protrudes out of the trunnion. The device may also include a limit switch coupled to the outer surface of the trunnion, where the limit switch contacts the cylinder. Separation of the limit switch and the cylinder causes actuation of the limit switch. The actuation of the limit switch stops a downward movement of the device. In other embodiments, the limit switch is coupled to the portion of the cylinder that protrudes out of the trunnion, and the limit switch contacts the trunnion. Separation of the limit switch and the trunnion, in these embodiments, causes actuation of the limit switch, stopping the downward movement of the device.

The invention also addresses problems associated with the prior art by providing a method of operating the dental device. The method includes providing a limit switch for the device that controls a downward movement of the device and initiating the movement of the device. The movement includes use of a cylinder and a trunnion. The method may also include detecting an obstruction, and in response to the detected obstruction, actuating the limit switch to stop the movement of the device.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there are described exemplary embodiments of the invention.

DETAILED DESCRIPTION

Figure 1:
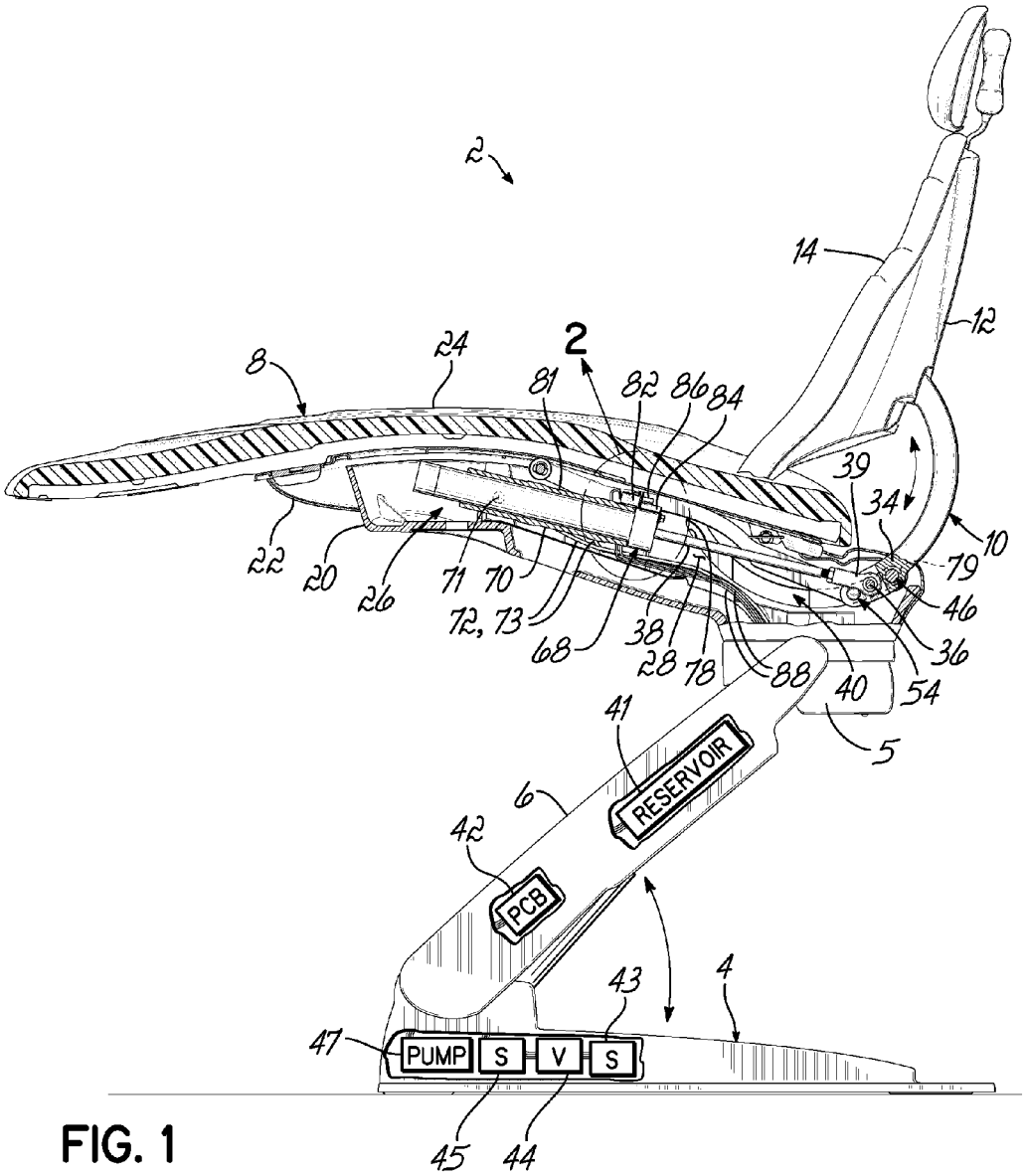
FIG. 1 is a side elevational view, partially in cross-section, of one embodiment a dental chair in a generally raised position relative to a floor surface, with a seatback in a generally upright position relative to the chair frame.

Turning to the drawings, wherein like numbers denote like parts throughout the several views, FIG. 1 shows one embodiment of a chair 2 for supporting a patient during examinations, treatments, or the like. The type of examinations and treatments may vary such that chair 2 may be used by many different types of practitioners. For example, the chair 2 may be used as part of a dental operatory to support a patient during dental procedures. To this end (and in a manner not shown herein), the chair 2 may be used in combination with any of the components typically associated with a dental operatory, such as: a dental delivery unit or tray that supports various instruments and tools, a cuspidor that permits patients to expel the contents of their mouths, an adjustable lamphead that illuminates the treatment area, and various other devices useful for the performance of dental procedures. A dentist, dental hygienist, or other user may operate the chair 2.

The chair 2 generally comprises a base 4, a lift arm 6 extending upwardly from base 4, and a seat assembly 8 supported by lift arm 6. The lift arm 6 raises and lowers the seat assembly 8 relative to the base 4. Lowering and raising the lift arm 6 is generally disclosed in U.S. patent application Ser. No. 12/262,887, filed on even date herewith by Hanus and entitled "DENTAL CHAIR WITH CANTILEVER FORWARD BASE" (MIDTF 467P2), the entire disclosure of which is incorporated by reference herein.

A seatback support 10 (referred to as a "carriage") extends generally upwardly from the seat assembly 8 for supporting a seatback frame 12 and a back cushion 14 mounted to the seatback frame 12. The seat assembly 8 includes a chair frame 20 pivotally mounted on a base structure 5, which is attached to the lift arm 6, a casing 22 mounted to the chair frame 20, and a seat cushion 24 positioned over the chair frame 20 and the casing 22. The seatback frame 12 may move downwardly by the downward movement of the seatback support 10 relative to the chair frame 20. The seatback frame 12 may move upwardly by the upward movement of the seatback support 10 relative to the chair frame 20. Indeed, the seatback frame 12 of the chair 2 can move from the generally upright orientation/position shown in FIG. 1 to a generally reclined orientation/position shown in FIG. 2.

It is worth noting that movement of the seatback frame 12 may be independent from movement of the lift arm 6, and vice versa. For example, the seatback frame 12 may be moved downwardly to a generally reclined position without raising or lowering the lift arm 6. Indeed, the two separate motions may be performed consecutively or may be performed at about the same time. Moreover, the chair 2 may be preprogrammed using conventional techniques to achieve a certain setting, which may include movement of the seatback frame 12 alone, movement of the lift arm 6, alone, or movement of both the seatback frame 12 and the lift arm 6. Movement by both to accomplish the preprogrammed setting may be performed consecutively or at about the same time.

The chair 2 may have an input member (not shown) for moving the seatback frame 12 downwardly, a separate input member (not shown) for moving the seatback frame 12 upwardly, a separate input member (not shown) for lowering the lift arm 6, a separate input member (not shown) for raising the lift arm 6, and/or a separate input member (not shown) for a certain preprogrammed setting. The input member may be a button that may be depressed, a foot pedal that may be depressed, etc. Alternatively, the input member need not be depressed and may simply require contact. The user may select any of these positions by depressing the foot pedal (not shown), for example, until the desired position is achieved. However, when a setting is preprogrammed, the user may simply depress, for example, the preprogrammed input member to initiate the movement of the preprogrammed setting. The movement may occur without further action by the user, and the user may even be able to walk away from the chair 2 to tend to another matter.

Figure 2:
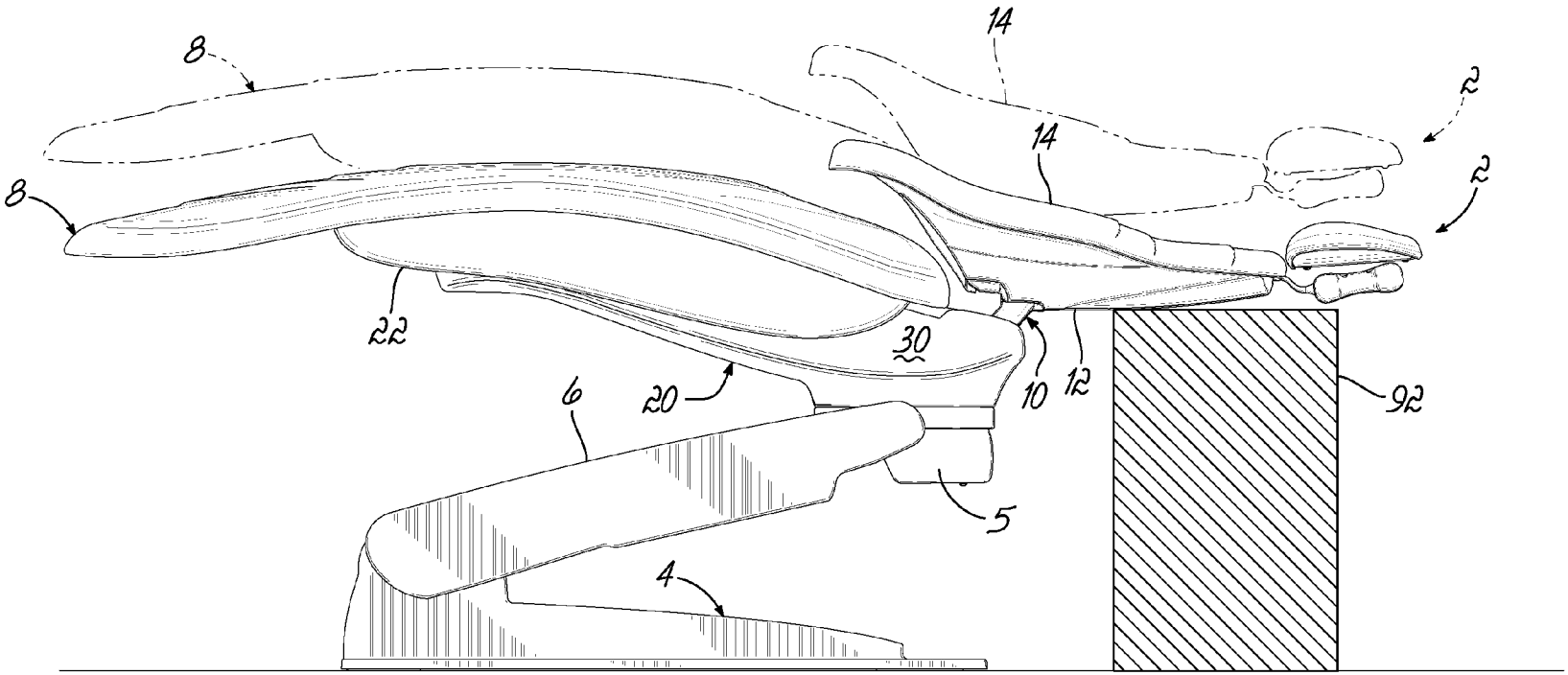
FIG. 2 is a side elevational view of the dental chair of FIG. 1 in a generally lowered position relative to the floor surface, with a seatback in a generally reclined position relative to the chair frame.

Thus, the transition of the chair 2 to the manner shown in FIG. 2 may be achieved by a user requesting the seatback frame 12 to be reclined and then by the user separately requesting the lift arm 6 to be lowered. Alternatively, the transition of the chair 2 to the positions shown in FIG. 2 may be a preprogrammed setting.

Figure 3:
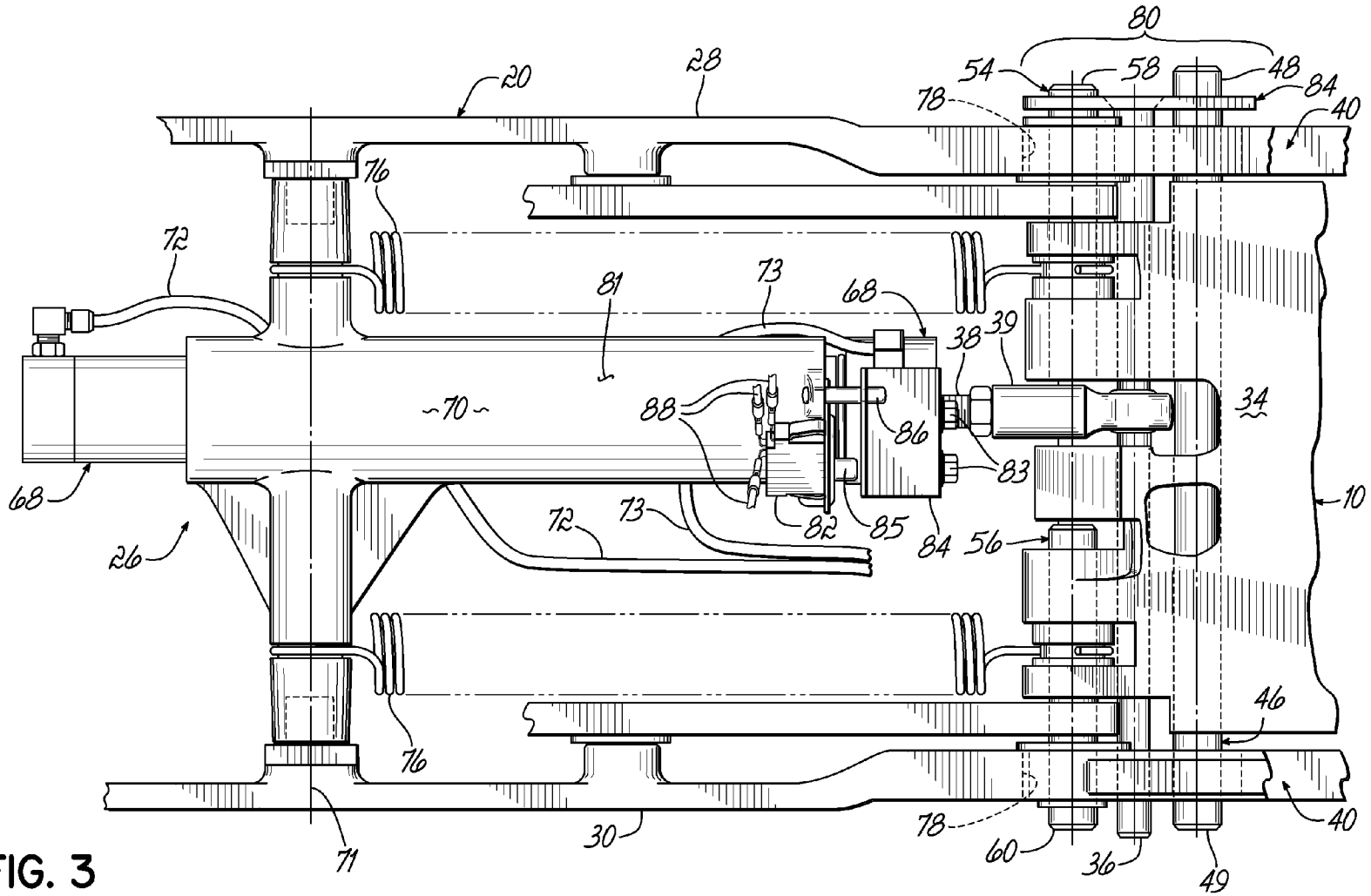
FIG. 3 is a partial top elevational view of the limit switch and drive assembly of the dental chair of FIG. 1 in a noncontacting state.

To move the seatback frame 12, the chair frame 20 supports a drive mechanism 26 between first sidewall 28 and second sidewall 30 (FIG. 3). The drive mechanism 26 is configured to slide seatback support 10 relative to the chair frame 20 along a predetermined path to move the seatback frame 12 between a generally upright position (FIG. 1; corresponding to a seated position of the patient) and a generally reclined position (FIG. 2; corresponding to a generally supine position of the patient). The seatback support 10 also includes a lower portion 34 received between the first sidewall 28 and the second sidewall 30 (FIG. 3). The drive mechanism 26 is connected to a support shaft 36 extending through the lower portion 34. More specifically, the drive mechanism 26 includes a cylinder rod 38 connected to the support shaft 36 via rod end 39 for applying a linear force to the lower portion 34 of the seatback support 10. When this force is applied, the lower portion 34 is guided through an arcuate path defined by arcuate tracks 40 in the first sidewall 28 and the second sidewall 30.

To support this arcuate motion, the chair 2 may also contain a hydraulic fluid reservoir 41 and control circuitry 42, both in the lift arm 6. The control circuitry 42 may be in the form of a printed circuit board (PCB). The chair 2 may also include a solenoid 43, which is associated with the drive mechanism 26 for the downward movement of the seatback frame 12. Solenoid 43 opens or closes a valve 44, with hydraulic fluid passing through the valve 44 when the valve 44 is opened. The chair 2 may additionally include a solenoid 45, which is associated with the drive mechanism 26 for the upward movement of the seatback frame 12. The solenoid 45 may also open or close the valve 44. Indeed, the valve 44 may be placed between the solenoids 43 and 45. Each of the solenoids 43, 45 may be configured to normally keep the valve 44 closed unless an electronic signal is sent to either of the solenoids 43, 45 to open the valve 44.

Additional solenoids and valves (not shown) may be utilized for the downward movement of the lift arm 6 to lower the lift arm 6. Similarly, separate solenoids and valves (not shown) may be utilized for the upward movement of the lift arm 6 to raise the lift arm 6. Nonetheless, all of the solenoids and valves, including the solenoids 43, 45 and the valve 44, may be within a manifold (not shown) in base 4. A pump 47 may be present as illustrated in FIG. 1 to support these movements and other movements. The pump 47 may be similar that disclosed in U.S. patent application Ser. No. 12/262,887, filed on even date herewith by Hanus and entitled "DENTAL CHAIR WITH CANTILEVER FORWARD BASE" (MIDTF 467P2), the entire disclosure of which is incorporated by reference herein. Additionally, these structures, and other structures, may be situated in locations that are different than those illustrated.

Turning to FIG. 3, which illustrates the components that guide the seatback support 10 through the arcuate motion and the drive mechanism 26 in more detail, a first guide shaft 46 extends through the lower portion 34 of the seatback support 10 behind (i.e., proximal of) the support shaft 36. First guide shaft 46 includes a first end portion 48 that extends through the arcuate track 40 of the first sidewall 28 and a second end portion 49 that extends through the arcuate track 40 of the second sidewall 30. Second and third guide shafts 54, 56 are substantially aligned along a common axis and extend partially through the lower portion 34 of the seatback support 10 in front of (i.e., distal of) the support shaft 36. The second guide shaft 54 includes an end portion 58 extending through the arcuate track 40 of the first sidewall 28, and the third guide shaft 56 includes an end portion 60 extending through the arcuate track 40 of the second sidewall 30. Bushings (not shown) and/or bearings (not shown) may be provided on each of the end portions 48, 49, 58, 60 to facilitate movement through the associated arcuate track 40. As can be appreciated, the first, second, and third guide shafts 46, 54, 56 cooperate with the arcuate tracks 40 to translate the linear forces applied by the cylinder rod 38 to the seatback support 10 into arcuate motion.

The drive mechanism 26 may include a one-way hydraulic cylinder 68 positioned within a cavity of a housing such as within a cavity of a trunnion 70. A portion of the cylinder 68, such as that closest to seatback support 10, may protrude out of the trunnion 70. The portion of the cylinder 68 that protrudes out of trunnion 70 may have an outside diameter of about 2¼ inches and an inside diameter of about 1¾ inches. The portion of the cylinder 68 within the cavity of the trunnion 70, and that does not protrude, may have an inside diameter of about 1½ inches. The trunnion 70 may have an outside diameter of about 2¼ inches. The trunnion 70 may also be pivotally mounted to the chair frame 20. Pivot axis 71 illustrates the general pivot point of the trunnion 70.

Returning to FIG. 1, when a operator requests that the seatback frame 12 transition into a reclined position, for instance, after a patient sits in the chair 2, the request may cause a signal to be sent to the control circuitry 42, which in turn, may cause the control circuitry 42 to send a signal to the solenoid 43 to open the valve 44. The control circuitry 42 may utilize transistor circuits to send electrical current to the solenoid 43, which moves a spool to open the valve 44. The opened valve 44 allows for hydraulic fluid (e.g., oil) to exit the cylinder 68 via the back hose 72 (e.g., a high pressure fitting). Upon exiting, the hydraulic fluid may flow to the manifold (not shown) containing the solenoid 43, and then through the opened valve 44 into the hydraulic fluid reservoir 41. Indeed, the hydraulic fluid may be under pressure, and the pressure may cause the exiting fluid to flow upwards into the hydraulic fluid reservoir 41. Front hose 73 (e.g., a low pressure fitting) may serve as a catchall hose to transport into the hydraulic fluid reservoir 41 any hydraulic fluid that may seep through the internal structure of the cylinder 68.

As the force of drive mechanism 26 is released by the exiting hydraulic fluid, one or more return springs 76 (FIG. 3) pull the support shaft 36 and the lower portion 34 of seatback support 10 toward a forward end 78 of each of the arcuate tracks 40. The first, second, and third guide shafts 46, 54, 56 (FIG. 3) cooperate with the arcuate tracks 40 to translate the applied forces into arcuate motion. Via this process, the seatback 10 support is reclined relative to the chair frame 20, with gravity being utilized to achieve the downward movement of the seatback 10, and of the seatback frame 12. Thus, the seatback frame 12 may transition from a generally upright position to a reclined position.

Once the reclined position is achieved, the control circuitry 42 stops signaling the solenoid 43, and the solenoid 43 closes the valve 44. When a reclined position is achieved by the seatback frame 12 may depend upon, for example, a preprogrammed setting, the length of time the request is held for by a user, etc. Nonetheless, additional hydraulic fluid may be prevented from exiting the cylinder 68 when the valve 44 is closed, and the reclined position may be maintained until a request for the generally upright position is received.

When a user requests that the seatback frame 12 transition into an upright position (e.g., with the user still sitting in the chair 2), the request may cause a signal to be sent to the control circuitry, which in turn, may cause the control circuitry 42 to send a signal to the solenoid 45 to open the valve 44. The control circuitry 42 may utilize transistor circuits to send electrical current to the solenoid 45, which moves a spool to open the valve 44. As such, the hydraulic fluid may flow from the hydraulic fluid reservoir 41 to the manifold (not shown) containing the solenoid 45, then through the opened valve 44, up into back hose 72, and into the cylinder 68. As the hydraulic fluid may be under pressure, the pressure may cause the fluid to flow upwards into the back hose 72. The front hose 73 may again serve as a catchall hose to transport seeping hydraulic fluid into the hydraulic fluid reservoir 41.

As the hydraulic fluid enters the cylinder 68, the hydraulic fluid acts on the cylinder rod 38, which in turn applies a pushing force to move the lower portion 34 of the seatback support 10 toward a rearward end 79 of each arcuate track 40. The first, second, and third guide shafts 46, 54, 56 (FIG. 3) cooperate with the arcuate tracks 40 to translate the applied forces into arcuate motion. As such, the seatback 10 support of the chair 2 is upright relative to the chair frame 20, and the seatback frame 12 transitions from the generally reclined position to the generally upright position. Once the generally upright position is achieved, the control circuitry 42 stops signaling the solenoid 45, and the solenoid 45 closes the valve 44. By closing the valve 44, additional hydraulic fluid may be prevented from entering the cylinder 68, and the upright position may be maintained until a request for the generally reclined position is received.

Next, the chair 2 may further include a locking assembly 80 (FIG. 3) associated with first sidewall 28 as generally disclosed in U.S. patent application Ser. No. 12,262,966, filed on even date herewith by Hanus et al. and entitled "PATIENT CHAIR WITH LOCKING ASSEMBLY" (MIDTF 469P2), the entire disclosure of which is incorporated by reference herein. Moreover, the chair 2 also includes a limit switch 82 to override a request to transition the seatback frame 12 from a generally upright position to a generally reclined position.

Figure 4:
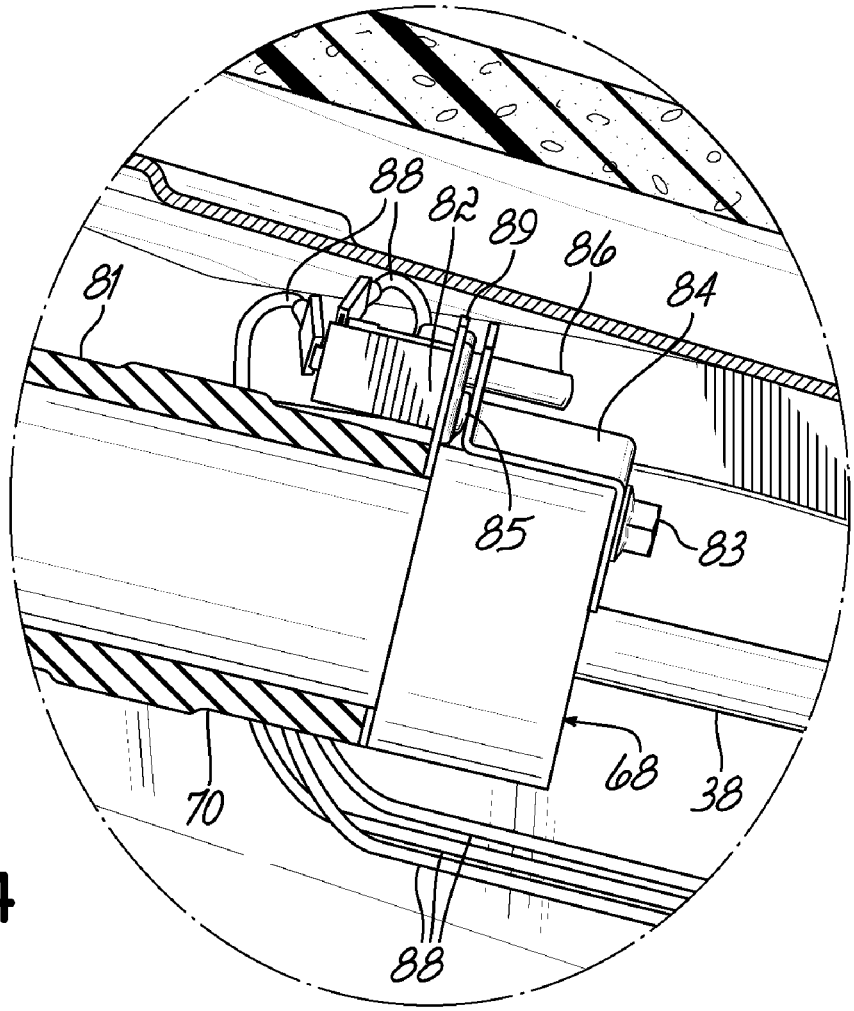
FIG. 4 shows a side elevational view in partial cross-section of the limit switch of the dental chair of FIG. 1 in a contacting state.

Turning to the view of the limit switch 82 in FIG. 4, the limit switch 82 may be coupled to an outer surface of the trunnion 70 via a limit switch mounting member 89 such as a bracket. As illustrated, the limit switch 82 generally hovers parallel to horizontal outer surface 81 of the trunnion 70 because it is supported by the limit switch mounting member 89. Member 89 may be coupled to a vertical outer surface of the trunnion 70. However, in some embodiments, the limit switch 82 may be directly coupled to the horizontal outer surface 81, instead of indirectly coupled to the horizontal outer surface 81 as illustrated in FIG. 1 and FIG. 4. Coupled to the protruding portion of the cylinder 68, via at least one attachment such as screws 83, is a bracket 84, and the limit switch 82 is operable to contact a contacting member such as the bracket 84. The limit switch 82 may have a limit switch member such as a button 85 coupled to it, with the button 85 in contact with the bracket 84. A contacting member may alternatively be a plate or other type of object with a surface that can contact the limit switch 82 and/or the limit switch member such as the button 85.

A restraint member such as a fastener 86 (such as a pin, a screw, etc.) may be coupled to the trunnion 70 and operable to engage the bracket 84 (e.g., by passing through the bracket 84). The fastener 86 may reduce or inhibit rotational movement of the cylinder 68 within the trunnion 70. The fastener 86 may be a low pressure fitting, and may also reduce or prevent interference with other components (e.g., interference of the front hose 73 on the cylinder 68 with the springs 76 in FIG. 3). The fastener 86 may additionally facilitate contact between the limit switch 82 and the bracket 84 by maintaining a generally stable axis for the contact.

The limit switch 82 may start off in a contacting state, as illustrated in FIG. 4. The contacting state may be characterized by contact between the limit switch 82 or limit member thereof and the trunnion 70. For example, the button 85 of the limit switch 82 is in contact with the bracket 84. During the contacting state, the button 85 of the limit switch 82 may be depressed (e.g., completely depressed or partially depressed) by the contact with the bracket 84. The springs 76 (FIG. 3) may keep the button 85 in contact with the bracket 84. Additionally, the limit switch 82 may be in communication with control circuitry 42 (FIG. 1) via wiring 88. The control circuitry 42 may be in communication with the solenoid 43, and the solenoid 43 is operable to open and close the valve 44, as discussed hereinabove.

Turning to FIG. 2, while transitioning the seatback support 10 relative to the chair frame 20 from the generally upright position to the generally reclined position, and thus transitioning the seatback frame 12 in response to a user request, one scenario that may occur is that the seatback frame 12 of the chair 2 comes in contact with an obstruction such as a box 92. Alternatively, another scenario that may occur is that after transitioning the seatback support 10 relative to the chair frame 20 from the generally upright position to the generally reclined position, and thus transitioning the seatback frame 12, the seatback frame 12 of the chair 2 may come in contact with the box 92 as the lift arm 6 is lowered in response to a user request. This latter scenario is depicted in FIG. 2. Nonetheless, under both scenarios the seatback frame 12 of the chair 2 may come in contact with the obstruction.

The obstruction may be an operator or a portion of the operator such as the legs of the operator. Alternatively, the obstruction may be an inanimate object such as the box 92 (FIG. 2), a stool or chair for the operator to sit on, etc. Nonetheless, when the seatback frame 12 of the chair 2 contacts the obstruction, the limit switch 82 may transition from a contacting state in FIG. 4 into a non-contacting state in FIG. 3. The non-contacting state actuates the limit switch 82. Alternatively, the limit switch 82 may initially be in a non-contacting state, and contact with the obstruction causes the limit switch 82 into a contacting state, which actuates the limit switch 82.

Turning to FIG. 3, specifically, the contact between the seatback frame 12 (FIG. 2) and the box 92 (FIG. 2) may extend the springs 76 enough to separate the button 85 of the limit switch 82 and the bracket 84 causing the limit switch 82 to be in a non-contacting state and actuated. As such, the extension in the springs 76 may detect the box 92 or other obstruction. The actuation of the limit switch 82 may cause a signal to be sent from the limit switch 82 via wiring 88 to the control circuitry 42 (FIG.1), which in turn may cause the control circuitry 42 to send a signal to the solenoid 43 (FIG. 1) to close the valve 44 (FIG. 1). As such, the closed valve 44 does not allow for additional hydraulic fluid to exit the cylinder 68, and causes the drive mechanism 26 to stop the downward movement of the seatback support 10. Thus, actuation of the limit switch 82 stops the downward movement of the seatback frame 12.

Indeed, actuation of the limit switch 82 may stop the flow of electric current to the solenoid 43. For example, there may be an interlock in control circuitry 42 between the limit switch 82 and the solenoid 43 such that they are wired together, with the electric current flowing from the limit switch 82 to the solenoid 43. Actuation of the limit switch 82 may break the electric current and cut power to the solenoid 43, which closes the valve 44.

Those of ordinary skill in the art will appreciate that by stopping the downward movement of the seatback frame 12 against the box 92, further damage to the box 92 may be reduced. Furthermore, when the obstruction is an operator or portion of the operator, stopping the downward movement may limit further pain or discomfort to the operator.

Figure 5A:
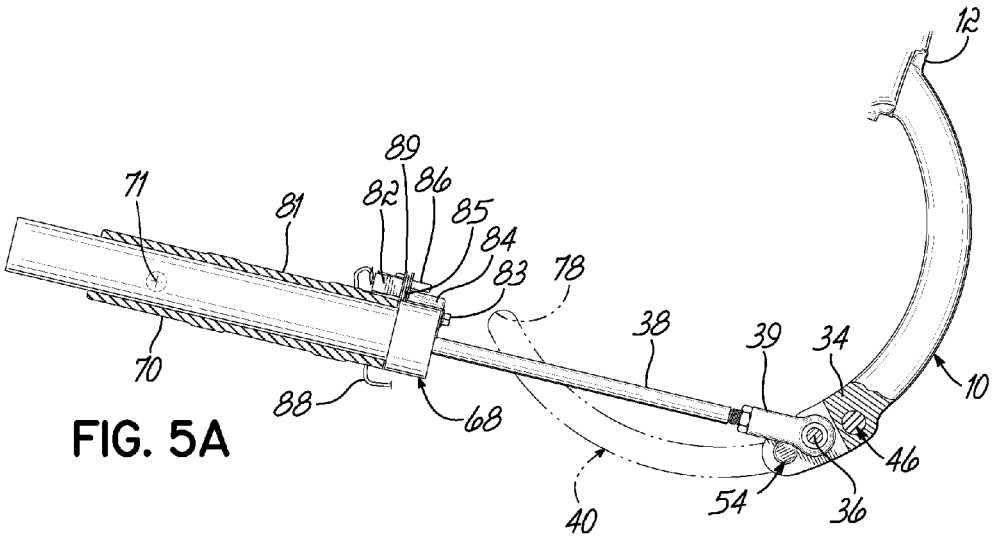
FIGS. 5A-5E are partial side elevational views in partial cross-section of various components of the dental chair of FIG. 1 illustrating the transition of the limit switch from a contacting state to a noncontacting state.
Figure 5B:
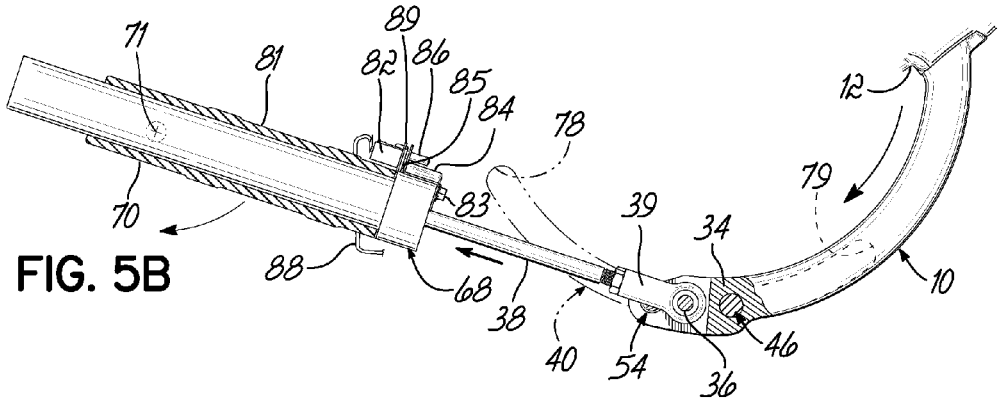

The transition of the limit switch 82 from the contacting state to the non-contacting state is illustrated in further detail in FIGS. 5A-5E. FIGS. 5A-5E generally correspond to the scenario illustrated in FIG. 2. Beginning with FIG. 5A, FIG. 5A illustrates the generally upright position of the seatback support 10, and thus of the seatback frame 12, illustrated in FIG. 1, with the limit switch 82 in a contacting state. In response to a request from the user to recline the seatback frame 12, the drive mechanism 26 is initiated as disclosed above. For example, the seatback support 10 moves downwardly along track 40 towards the forward end 78 as the cylinder rod 38 moves towards the cylinder 68, illustrated in FIG. 5B, in response to the exiting hydraulic fluid. The trunnion 70 also begins to pivot about the axis 71.

Figure 5C:
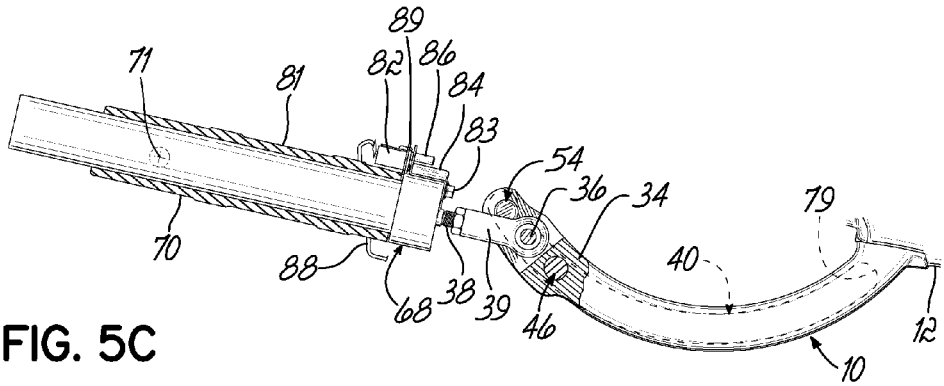
Figure 5D:
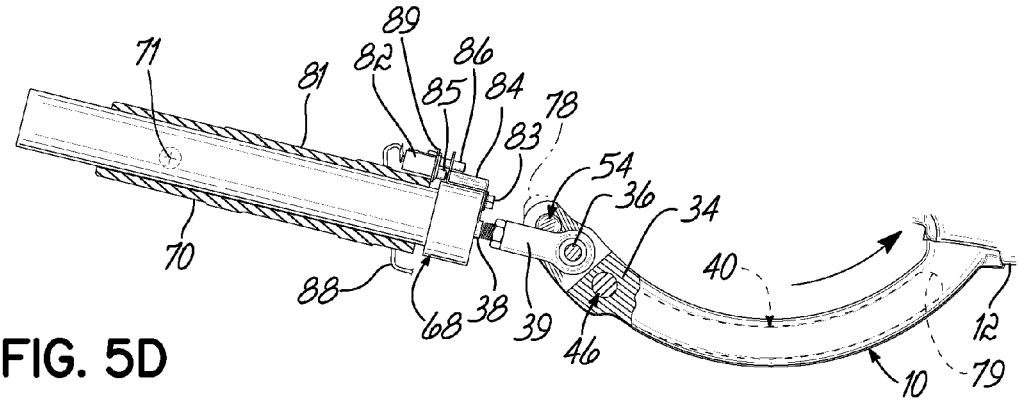

FIG. 5C illustrates the seatback support 10 at the forward end 78, with the seatback frame 12 in the generally reclined position. Turning to FIG. 5D, in response to a request by the user to lower the lift arm 6 (FIG. 1), the lift arm 6 lowers with the seatback frame 12 in the reclined position. When the seatback frame 12 contacts an obstruction, such as the box 92 (FIG. 2), the cylinder, which is slideably mounted in the trunnion 70, begins to exit from the trunnion 70 via the springs 76 (FIG. 3). Specifically, the movement is due to the low force exerted by the springs 76. Indeed, a gap is illustrated between the protruding portion of the cylinder 68 and the trunnion 70. The exiting cylinder 68 also moves the bracket 84 away from the button 85. The exiting cylinder 68 may also cause the seatback support 10 to travel upwards along the track 40 to the rearward end 79.

Figure 5E:
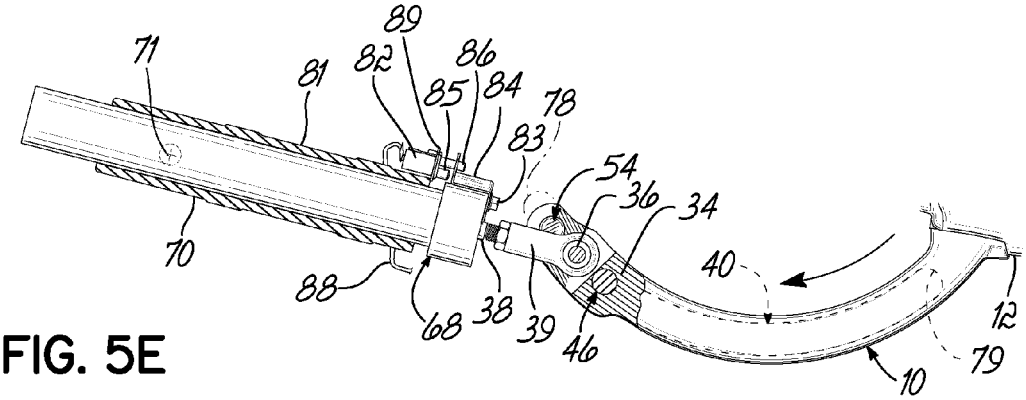

By FIG. 5E, the bracket 84 has separated from the button 85 to cause a non-contacting state and actuation of the limit switch 82. The actuation of the limit switch 82 stops the drive mechanism 26 (FIG. 1) as described hereinabove by causing the valve 44 (FIG. 1) to close. After separation, the springs 76 (FIG. 3) may return the exiting cylinder 68, and the bracket 84 coupled to the cylinder, towards the trunnion 70, which may in turn cause the seatback support 10 to move downwardly towards the forward end 78. As such, the limit switch 82 may return to a contacting state.

It is worth noting that the limit switch 82 may be actuated more often when the user utilizes a preprogrammed setting because in such an instance, the user may walk way from the chair 2 as he or she may not need to keep an input member depressed for the movement to occur.

In some embodiments, program code may be implemented to prevent (e.g., temporarily prevent) initiation of a downward movement in response to actuation of the limit switch 82. As such, a user, for example, may not be able to lower the seatback frame 12 any further if he or she accidentally clicks on the input member (not shown) to move the seatback frame 12 downwards instead of the input member to move the seatback frame 12 upwards. Furthermore, in some embodiments, program code may be implemented to automatically initiate another movement. For example, an upward movement of the seatback frame 12 may be initiated via the program code upon actuation of the limit switch 82 to ease a user's pain or discomfort.

In general, the program code may include the routines executed to implement or initiate movements of the chair 2, whether the program code is implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in the computer such as with control circuitry 42 (FIG. 1), cause performance of the steps necessary to execute steps or elements embodying the various aspects of the movements.

Given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

Figure 6:
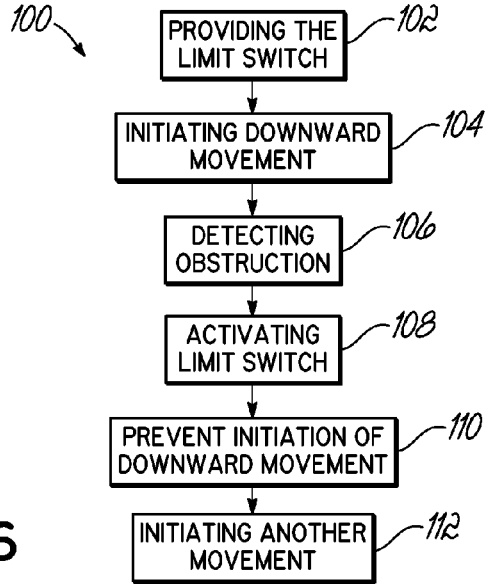
FIG. 6 is a flowchart of a routine for operating the dental chair of FIG. 1.

With reference to FIG. 1 and FIG. 6, the routine 100 in FIG. 6 illustrates but one example of operating the dental chair 2, including the operation with respect to the program code. In block 102, the chair 2 may be provided with the limit switch 82. For example, the limit switch 82 may be provided during creation of the chair 2 or to retrofit a dental chair. Additionally, the springs 76 (FIG. 3) may also be provided. Next, downward movement of the seatback frame 12 via seatback support 10 of the chair 2 may be initiated in block 104, with the movement including use of the cylinder 68 and the trunnion 70. Next, the obstruction may be detected (block 106), and in response to the detected obstruction, the limit switch 82 may be actuated to inhibit the downward movement (block 108). Furthermore, in response to actuation of the limit switch 82, the program code may prevent initiation of further downward movement (block 110) (e.g., temporarily prevent initiation) and/or may automatically initiate another movement (block 112) such as an upward movement of the seatback frame 12 via the seatback support 10.

Next, in some embodiments, the chair 2 may include at least one at electric field sensor (not shown) having capacitive sensing in the seatback frame 12. The sensor may be operable to detect a change in capacitance created by contact with an obstruction that is a user and actuate the limit switch 82. The sensor (not shown) may function cooperatively with the limit switch 82, and may additionally actuate the limit switch 82. A single sensor may cover, for example, the entire seatback frame 12. Alternatively, multiple sensors may cover separate portions of the seatback frame 12. More information about electric field sensors may be found in U.S. patent application Ser. No. 12/262,916, filed on even date herewith by Edelmann and entitled "DEVICE WITH AN ELECTRIC FIELD SENSOR, CONTROL CIRCUITRY, AND A SOLENOID" (MIDTF 472P2), the entire disclosure of which is incorporated by reference herein.

While exemplary embodiments have been described in considerable detail herein, it is not the intention of the application to restrict or in any way limit the scope of the appended claims to such detail. Additional advantages and modifications will readily appear to those skilled in the art. For example, with reference to FIG. 4, the setup may be reversed, with the limit switch 82 on the protruding portion of the cylinder 68 and the bracket 84 on the top outer surface of the trunnion 70.

Alternatively, as the outer diameter of the trunnion 70 and the outer diameter of the protruding portion of the cylinder 68 may be the same, the limit switch 82 may simply be placed in between the trunnion 70 and the cylinder 68, on either the trunnion 70 or the cylinder 68. Moreover, with respect to the trunnion 70, the limit switch 82 may be generally placed on the vertical outer surface (e.g., directly on the vertical outer surface or indirectly on the vertical outer surface) closest to the protruding portion of the cylinder 68, instead generally placed on the horizontal outer surface 81 that the limit switch 82 is placed on in FIG. 4. Furthermore, the bracket 84 and the button 85 may also be omitted. A limit switch different from that of limit switch 82 may alternatively be utilized.

Additionally, with reference to FIG. 3, those skilled in the art will appreciate that the arrangement disclosed herein is merely one example of how seatback support 10 may slide relative to chair frame 20. Indeed, chair 2 may alternatively include a two-way hydraulic cylinder, a mechanical linear actuator, or any other type of drive mechanism 26 for moving seatback support 10 relative to chair frame 20. Other modifications are also possible.

Therefore, the invention in its broader aspects is not limited to the specific details or representative devices and method, and illustrative examples shown and described. Accordingly, departures may be made form such details without departure from the spirit or scope of applicant's general inventive concept.

What is claimed is:

1. A dental device comprising:

a cylinder;

a trunnion having a cavity and an outer surface, wherein a portion of the cylinder is slidably mounted within the cavity of the trunnion, and wherein a portion of the cylinder protrudes out of the trunnion; and a limit switch coupled to the outer surface of the trunnion, the limit switch operable to contact the cylinder, wherein separation of the limit switch and the cylinder causes actuation of the limit switch, wherein the actuation of the limit switch inhibits a downward movement of the device.

2. The device of claim 1, further comprising a contacting member coupled to the portion of the cylinder that protrudes out of the trunnion and having a first surface opposing the limit switch, the contacting member operable to contact the limit switch, and wherein separation of the limit switch and the first surface of the contacting member causes actuation of the limit switch.

3. The device of claim 2, further comprising a limit switch member coupled to the limit switch, and wherein separation of the limit switch member and the first surface of the contacting member causes actuation of the limit switch.

4. The device of claim 2, wherein the contacting member is a bracket.

5. The device of claim 2, further comprising a restraint member coupled to the trunnion, the restraint member operable to engage the contacting member and reduce rotational movement of the cylinder.

6. The device of claim 1, wherein the device is a dental chair.

7. The device of claim 1, wherein the limit switch and the cylinder separate in response to contact with an obstruction.

8. The device of claim 1, further comprising at least one spring mounted to the trunnion, the spring configured to separate the limit switch and the cylinder in response contact with an obstruction.

9. The device of claim 1, further comprising at least one electric field sensor having capacitive sensing and operable to detect a change in capacitance, the electric field sensor operable to actuate the limit switch in response to detecting a change in capacitance created by contact with an obstruction.

10. The device of claim 1, further comprising program code to automatically initiate another movement of the device in response to actuation of the limit switch.

11. The device of claim 1, further comprising program code operable to prevent initiation of a downward movement in response to actuation of the limit switch.

12. The device of claim 1, further comprising a seatback, and wherein the actuation of the limit switch stops a downward movement of the seatback of the device.

13. The device of claim 1, further comprising a seatback, and wherein the limit switch and the cylinder separate in response to contact by the seatback with an obstruction.

14. A dental device comprising:

a cylinder;

a trunnion having a cavity and an outer surface, wherein a portion of the cylinder is slidably mounted within the cavity of the trunnion, and wherein a portion of the cylinder protrudes out of the trunnion;

a limit switch coupled to the portion of the cylinder that protrudes out of the trunnion, the limit switch operable to contact the trunnion, wherein separation of the limit switch and the trunnion causes actuation of the limit switch, the actuation of the limit switch inhibits a downward movement of the device.

15. The device of claim 14, further comprising a contacting member having a first surface opposing the limit switch and coupled to the outer surface of the trunnion, the contacting member operable to contact the limit switch, and wherein separation of the first surface of the contacting member and the limit switch causes actuation of the limit switch.

16. The device of claim 15, further comprising a limit switch member coupled to the limit switch, and wherein separation of the limit switch member and the first surface of the contacting member causes actuation of the limit switch.

17. The device of claim 15, wherein the contacting member is a bracket.

18. The device of claim 15, further comprising a restraint member coupled to the trunnion, the restraint member operable to engage the contacting member and reduce rotational movement of the cylinder.

19. The device of claim 14, wherein the device is a dental chair.

20. The device of claim 14, wherein the limit switch and the trunnion separate in response to contact with an obstruction.

21. The device of claim 14, further comprising at least one spring mounted to the trunnion, the spring configured to separate the limit switch and the trunnion in response contact with an obstruction.

22. The device of claim 14, further comprising at least one electric field sensor having capacitive sensing and operable to detect a change in capacitance, the electric field sensor operable to actuate the limit switch in response to detecting a change in capacitance created by contact with an obstruction.

23. The device of claim 14, further comprising program code to automatically initiate another movement of the device in response to actuation of the limit switch.

24. The device of claim 14, further comprising program code operable to prevent initiation of a downward movement in response to actuation of the limit switch.

25. The device of claim 14, further comprising a seatback, and wherein the actuation of the limit switch stops a downward movement of the seatback of the device.

26. The device of claim 14, further comprising a seatback, and wherein the limit switch and the trunnion separate in response to contact by the seatback with an obstruction.

27. A method of operating a dental device, the method comprising:

providing a limit switch for the device that controls a downward movement of the device;

initiating the movement of the device, wherein the movement includes use of a cylinder and a trunnion;

detecting an obstruction in the path of the downward movement of the device; and in response to the detected obstruction, actuating the limit switch to inhibit the movement of the device.

* * * * *